US008717123B2

(12) United States Patent
Schreiber et al.

(10) Patent No.: US 8,717,123 B2
(45) Date of Patent: May 6, 2014

(54) FOLDED COAXIAL RADIO FREQUENCY MIRROR

(75) Inventors: Adam W. Schreiber, Fredericksburg, VA (US); Louis F. DeChiaro, Jr., Middletown, DE (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 395 days.

(21) Appl. No.: 12/924,026

(22) Filed: Sep. 17, 2010

(65) Prior Publication Data

US 2012/0313734 A1 Dec. 13, 2012

(51) Int. Cl.
*H01P 1/202* (2006.01)

(52) U.S. Cl.
CPC ..... *H01P 1/202* (2013.01)
USPC ..... 333/206; 333/245

(58) Field of Classification Search
CPC ..... H01P 1/202
USPC ..... 333/206, 222, 245
See application file for complete search history.

(56) References Cited

U.S. PATENT DOCUMENTS

| | | | | |
|---|---|---|---|---|
| 2,630,490 | A * | 3/1953 | Richards | 333/206 |
| 2,637,781 | A * | 5/1953 | Bohnert | 333/33 |
| 4,636,759 | A * | 1/1987 | Ishikawa et al. | 333/223 |
| 6,538,524 | B1 | 3/2003 | Miller | 333/12 |
| 7,733,195 | B2 | 6/2010 | Conway et al. | 333/81 |
| 2008/0224802 | A1 | 9/2008 | Conway et al. | 333/81 |

* cited by examiner

*Primary Examiner* — Benny Lee
(74) *Attorney, Agent, or Firm* — Gerhard W. Thielman, Esq.

(57) ABSTRACT

A coaxial mirror is provided for reflecting an electromagnetic signal. The mirror includes an outer pipe, an inner pipe, and first and second rods. The outer pipe extends between input and output ports, with closed initial and final terminals disposed at their respective ports. The inner pipe extends between a closed fore end and an open aft end. The inner pipe is coaxially disposed between the initial and final terminals within the outer pipe. The first rod, coaxially disposed within the outer pipe, extends from the input port to the fore end. The second rod, coaxially disposed within the inner pipe, extends from downstream of the fore end to the output port. Preferably, the first and second pipes are cylindrical tubes. Preferably, fluoropolymer fills the annular region between the inner and outer pipes, and fluoropolymer foam fills the inner pipe. Preferably, the first pipe has an electrically conductive inner surface, the second pipe has electrically conductive inner and outer surfaces, and the first and second rods have conductive surfaces. A first embodiment includes a conductor, coaxially disposed within the inner pipe, that extends from the fore end to the second rod. In a second embodiment, the second rod is hollow, and is preferably filled with the foam.

8 Claims, 3 Drawing Sheets

| | | | | | |
|---|---|---|---|---|---|
| $\mu_1$ | 1 | $\varepsilon_1$ | 1 | Air | |
| $\mu_2$ | 1 | $\varepsilon_2$ | 2.1 | Teflon | |
| $\mu_3$ | 1 | $\varepsilon_3$ | 1.65 | Teflon Foam | |

220

| | | | |
|---|---|---|---|
| $2r_{i1}$ | 0.00635 m | $2r_{o1}$ | 0.0340 m |
| $2r_{i2}$ | 0.0338 m | $2r_{o2}$ | 0.0340 m |
| $2r_{i3}$ | 0.0036 m | $2r_{o3}$ | 0.03048 m |

210

200

| | |
|---|---|
| $Z_{01}$ | 100 Ω |
| $Z_{02}$ | 0.244 Ω |
| $Z_{03}$ | 100 Ω |

230

| | |
|---|---|
| $Z_{01}$ | 100 Ω |
| $Z_{02}$ | 0.244 Ω |
| $Z_{03}$ | 100 Ω |
| $Z_{04}$ | 100 Ω |

530

| | | | |
|---|---|---|---|
| $\mu_1$ | 1 | $\varepsilon_1$ | 1 | Air |
| $\mu_2$ | 1 | $\varepsilon_2$ | 2.1 | Teflon |
| $\mu_3$ | 1 | $\varepsilon_3$ | 1.65 | Teflon Foam |
| $\mu_4$ | 1 | $\varepsilon_4$ | 1.65 | Teflon Foam |

520

| | | | |
|---|---|---|---|
| $2r_{i1}$ | 0.00635 m | $2r_{o1}$ | 0.0340 m |
| $2r_{i2}$ | 0.0338 m | $2r_{o2}$ | 0.0340 m |
| $2r_{i3}$ | 0.0036 m | $2r_{o3}$ | 0.03048 m |
| $2r_{i4}$ | 0.0034 m | $2r_{o4}$ | 0.0036 m |

500

510

FOLDED COAXIAL RADIO FREQUENCY MIRROR

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to coaxial radio frequency (RF) mirrors. In particular, the invention relates to a more convenient design intended for field application.

Radar applications incorporate narrow-band filtering under inelastic scattering in which a strong continuous-wave transmission signal at a transmit wavelength encounters a target that returns a faint echo at a return wavelength slightly shifted from the transmit wavelength. (This condition contrasts from elastic scattering that lacks the wavelength shift in return signal.) The radar receiver thus listens for a weak return signal near the frequency of the stronger transmit signal. Narrow-band filtering employs co-axial RF mirrors to reflect the signal through a gain medium to enable detection.

SUMMARY OF THE INVENTION

A coaxial RF mirror can be employed to provide narrow-band filtering. However, conventional RF mirrors lack qualities that facilitate field use due to design constraints that render these delicate and awkward.

Conventional coaxial RF mirrors yield disadvantages addressed by various exemplary embodiments of the present invention. In particular, the exemplary embodiments described herein improve the ability to field such electromagnetic reflectors with increased ruggedness and reduced length.

Various exemplary embodiments provide a coaxial mirror for reflecting an electromagnetic signal. The mirror includes an outer pipe, an inner pipe, and first and second rods. The outer pipe extends between input and output ports, with closed initial and final terminals disposed at their respective ports. The inner pipe extends between a closed fore end and an open aft end. The inner pipe is coaxially disposed between the initial and final terminals within the outer pipe. The first rod, coaxially disposed within the outer pipe, extends from the input port to the fore end. The second rod, coaxially disposed within the inner pipe, extends from downstream of the fore end to the output port.

Preferably, the outer and inner pipes are cylindrical tubes. Preferably, fluoropolymer fills the annular region between the inner and outer pipes, and fluoropolymer foam fills the inner pipe. Preferably, the outer pipe has an electrically conductive inner surface, the inner pipe has electrically conductive inner and outer surfaces, and the first and second rods have conductive surfaces. In various exemplary embodiments, the mirror includes a conductor, coaxially disposed within the inner pipe, which extends from the fore end to the second rod. In alternate exemplary embodiments, the second rod is hollow, and is preferably filled with the foam.

BRIEF DESCRIPTION OF THE DRAWINGS

These and various other features and aspects, of various exemplary embodiments will be readily understood with reference to the following detailed description taken in conjunction with the accompanying drawings, in which like or similar numbers are used throughout, and in which.

DETAILED DESCRIPTION OF THE INVENTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figures 1, 2:
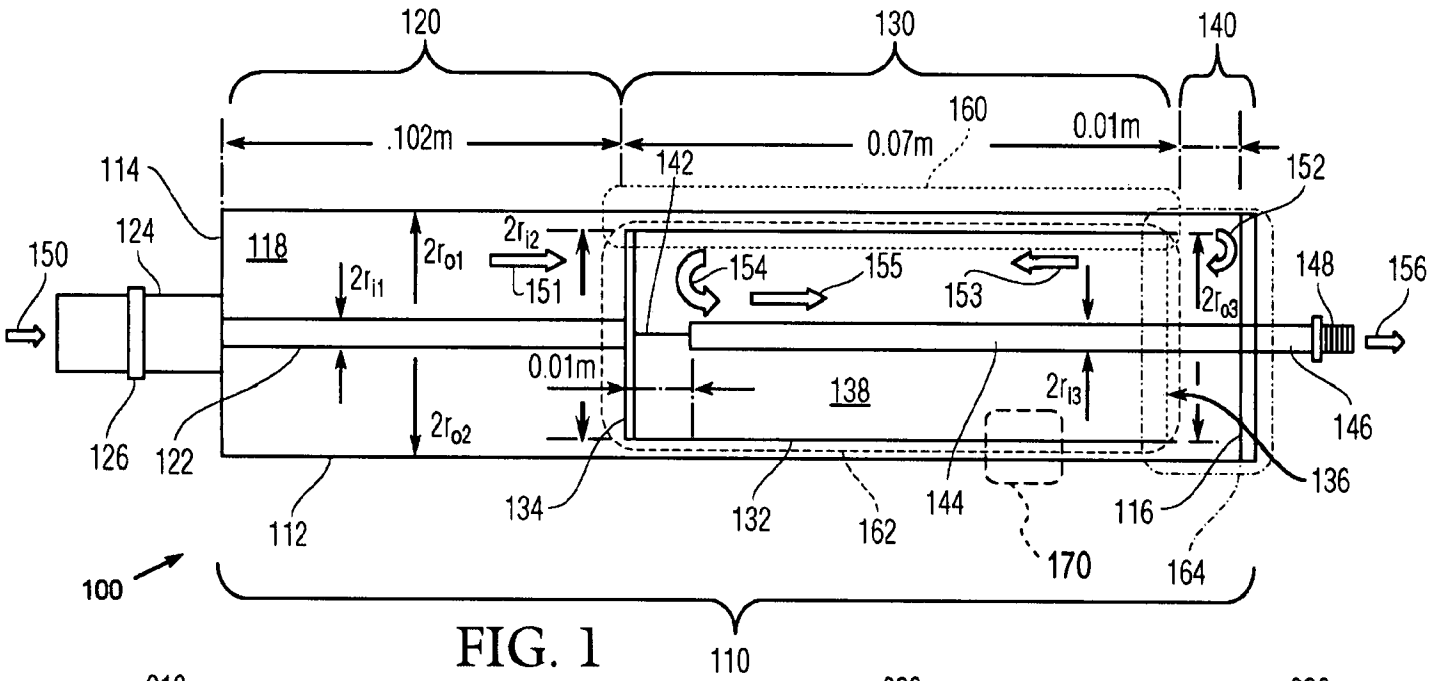
FIG. 1 is an elevation cross-sectional view of an RF mirror.
FIG. 2 is a tabular view of dimensions and material properties of sections in the mirror.

FIG. 1 shows an elevation cross-section view of a folded coaxial radio frequency (RF) mirror 100 in cross-section with inner and outer coaxial pipes. An outer tube assembly 110 comprises an outer cylindrical tube 112 bounded by an inlet end 114 and an outlet end 116 to define a first cavity 118 that includes a forward section 120 filled with air. In exemplary embodiments, the forward section 120 extends 0.102 meter in length. A fore rod 122 extends along the forward section 120. An inlet port 124, with a coaxial input connector 126 (such as series-N), attaches upstream of the inlet end 114.

An inner tube assembly 130 includes an inner cylindrical tube 132 defined by an inlet end 134 and an open outlet boundary 136 to define a second cavity 138 that leads to an outlet section 140 filled with fluoropolymer foam. The outlet section 140 extends between the outlet boundary 136 and the outlet end 116. In exemplary embodiments, the assembly 130 and the outlet section 140 respectively extend 0.07 meter and 0.01 meter in length. An electrically conductive pin 142 extends downstream from the inlet end 134 to an aft rod 144 that extends through the outlet end 116 to an outlet port 146 that attaches to an SMA-type output connector 148. In exemplary embodiments, the pin 142 extends 0.01 meter.

An input signal 150 is received through the input connector 126 and into the first cavity 118 travelling along the interior walls of the outer cylindrical tube 112 in a downstream direction 151. The signal travels along the annular concentric region between the inner wall of the outer cylindrical tube 112 and the outer wall of the inner cylindrical tube 132. The signal reverses propagation direction 152 upon reaching the outlet boundary 136 and proceeds to travel in the upstream direction 153 along the inner wall of the inner cylindrical tube 132. The signal reverses propagation direction 154 upon reaching the inlet end 134 and travels in the downstream direction 155 along the exterior of the aft rod 144 until exiting as an output signal 156.

The forward section 120 defines a first region for signal propagation filled with air. An outer annular envelope 160 defines a second region between the cylindrical tubes 112 and 132, which is enveloped with fluoropolymer, such as polytetrafluoroethylene under tradename Teflon®, such as wrapping with tape of that material. A third region includes an inner annular envelope 162 that defines the second cavity 138, minus the aft rod 144 contained in the inner cylindrical tube 132. The second cavity 138 is filled with fluoropolymer foam. The aft section 140, also filled with fluoropolymer foam, constitutes a terminal region before reaching signal exit.

FIG. 2 shows tabular lists 200 of dimensions and properties of the regions. The first tabular list 210 includes diameters (i.e., chord that passes through the tube longitudinal axis equivalent to twice the radius from that centerline) in the three regions, the first pair of columns for the inner values, and the second pair of columns for the outer values. The regions of the mirror 100 in FIG. 1 correspond to:

(1) the forward section 120 that defines the first cavity 118 and includes the outer cylindrical tube 112 with inner diameter of $2\times r_{o1}$ and fore rod 122 with outer diameter of $2\times r_{i1}$;

(2) the outer annular envelope 160 that includes the outer cylindrical tube 112 with inner diameter of $2\times r_{o2}$ (identical to $2\times r_{o1}$) and inner cylindrical tube 132 with outer diameter of $2\times r_{i2}$; and (3) the inner annular envelope 162 that defines the second cavity 138 and includes inner cylindrical tube 132 with inner diameter of $2\times r_{o3}$ and aft rod 144 with outer diameter of $2\times r_{i3}$. The second tabular list 220 in FIG. 2 includes the permeability $\mu$ and the permittivity $\in$ of the cavities of the three regions, with the filling materials identified alongside. The third tabular list 230 in FIG. 2 includes the impedance Z of each of the three regions.

In the first tabular list 210 in FIG. 2 listing inner and outer diameter boundaries of the three cavity regions, the first row (for the forward section 120 or first region) identifies the outer diameter of the fore rod 122 as $2\times r_{i1}=0.00635$ m, and the inner diameter of the outer cylindrical tube 112 as $2\times r_{o1}=0.0340$ m. The second row (for the outer envelope 160 or second region) identifies the outer diameter of the inner cylindrical tube 132 as $2\times r_{i2}=0.0338$ m, and the inner diameter of the outer cylindrical tube 112 as $2\times r_{o2}=0.0340$ m. The third row (for the inner envelope 162 or third region within the cavity 138) identifies the outer diameter of the aft rod 144 as $2\times r_{i3}=0.0036$ m, and the inner diameter of the inner cylindrical tube 132 as $2\times r_{o3}=0.03048$ m. The diameters are denoted in the mirror 100 as double-radii.

In the second tabular list 220 in FIG. 2, all regions have substantially similar relative values of magnetic permeability $\mu$, proportional to the vacuum value of $4\pi\times10^{-7}$ N $A^{-2}$. Typical materials, ranging from copper and aluminum to water share approximately this unity value treated as $\mu_1=\mu_2=\mu_3=1$ for the three regions. By contrast, comparative values of relative permittivity vary from aluminum at −1300 to strontium titanate at +310, proportional to the vacuum value of $8.854\times10^{-12}$ $A^2$ $s^4$ $kg^{-1}$ $m^{-3}$. The relative permittivity for air in the first region is approximately unity as $\in_1=1$, whereas $\in_2=2.1$ in the second region represents the corresponding relative permittivity value for Teflon®, and $\in_3=1.65$ in the third region provides an intermediate value of relative permittivity for a Teflon foam mixture. In the third tabular list 230, the first and third (and terminal) regions have an impedance of $Z_{o1}=Z_{o3}=100\Omega$, and the second region has a lower impedance of $Z_{o2}=0.244\Omega$.

Figure 3:
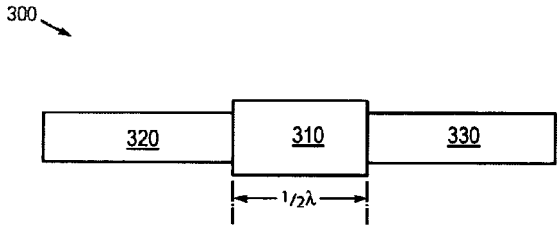
FIG. 3 is a block diagram of a narrow band-pass filter that employs the mirror.

FIG. 3 presents a block diagram 300 of a narrow-band regenerative filter with a gain medium 310 flanked by an input mirror 320 and an output mirror 330. The mirrors 320, 330 are analogous to the coaxial mirror 100 that exhibits low losses. The medium 310 provides a limited gain of 3 dB intended to compensate for attenuation losses while avoiding amplification that causes signal oscillation. The medium 310 extends a half-wavelength (½λ) of the filtered signal. The oscillation behaves as an Airy function, which represents the solution of y=Ai(x) to the differential equation y"−xy=0. The mirrors 320, 330 reflect the signal passing through the medium 310 to enable detection of the weak return signal.

Figures 4, 5:
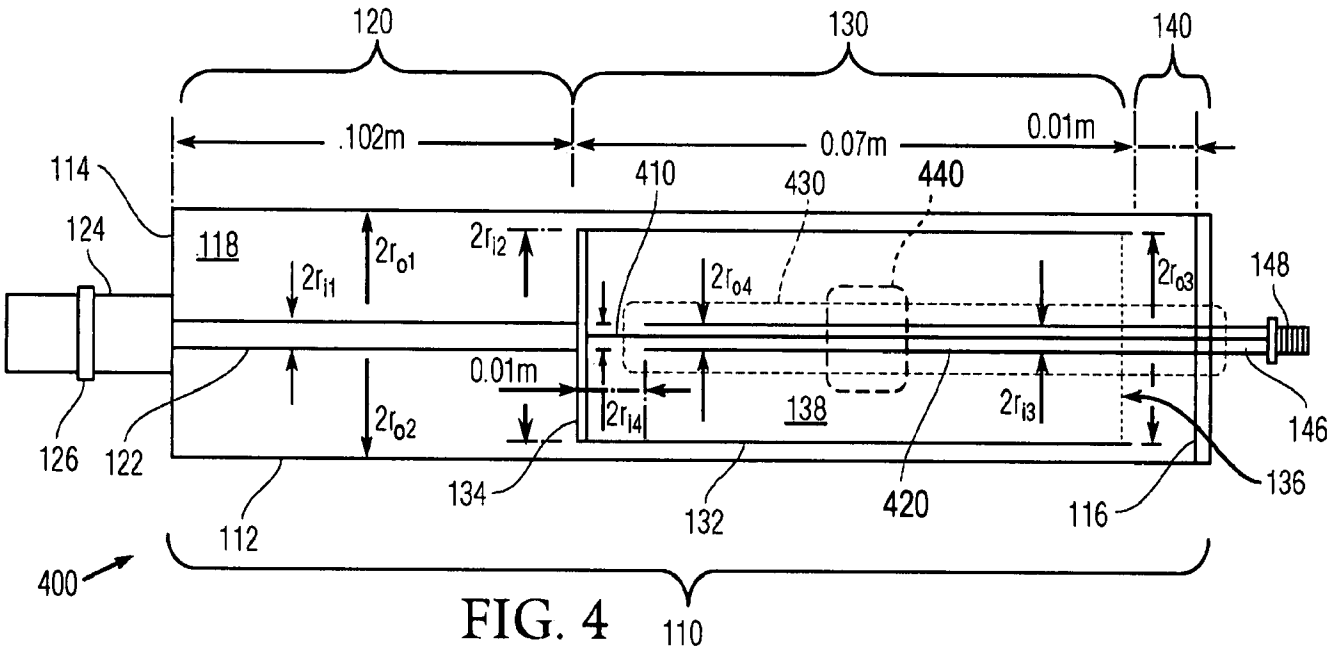
FIG. 4 is an elevation cross-sectional view of an alternate RF mirror.
FIG. 5 is a tabular view of dimensions and material properties.

FIG. 4 shows an elevation cross-section view of a folded coaxial radio frequency (RF) mirror 400 in cross-section with inner and outer coaxial pipes as a secondary embodiment. A communication wire 410 extends coaxially through the inner tube assembly 130 and connects to the output connector 148. A hollow tube 420 coaxially envelopes the wire 410 across most of its length from the outlet port 146. The tube 420 opens adjacent and downstream of the inlet end 134 to produce a sixth region 430 filled with fluoropolymer foam through which the signal travels. A detail seventh region 440 provides a cross-section of the wire 410 and the tube 420 within the cavity 138.

FIG. 5 shows tabular lists 500 of dimensions and properties of the first, second, third and sixth regions. The fourth tabular list 510 includes diameters; the fifth tabular list 520 provides the dielectric constants $\mu$ and $\in$, with the filling materials identified alongside; the sixth tabular list 530 includes the impedances Z. Dimensions of the sixth region 430 are defined by the inner diameter $2\times r_{i4}$ of the hollow tube 420 (as 0.0034 m), and the material characteristics correspond to fluoropolymer foam. The hollow tube 420 has an outer diameter $2\times r_{i3}=2\times r_{o4}$ (as 0.0036 m) corresponding to the third region 162 (shown in FIG. 1) with remaining dimensions corresponding to values from the first tabular list 210. In particular, the fourth tabular list 510 in FIG. 5 lists inner and outer diameter boundaries of four cavity regions, the first row (for the forward section 120 or first region) identifies the outer diameter of the fore rod 122 as $2\times r_{i1}=0.00635$ m, and the inner diameter of the outer cylindrical tube 112 as $2\times r_{o1}=0.0340$ m. The second row (for the outer envelope 160 or second region in FIG. 1) identifies the outer diameter of the inner cylindrical tube 132 as $2\times r_{i2}=0.0338$ m, and the inner diameter of the outer cylindrical tube 112 as $2\times r_{o2}=0.0340$ m. The third row (for the inner envelope 162 in FIG. 1, or the third region within the cavity 138) identifies the outer diameter of the hollow tube 420 as $2\times r_{i3}=0.0036$ m, and the inner diameter of the inner cylindrical tube 132 as $2\times r_{o3}=0.03048$ m. The fourth row (for the inner envelope 430, or the sixth region within the cavity 138) identifies the inner diameter of the hollow tube 420 as $2\times r_{i4}=0.0034$ m, and the outer diameter of the hollow tube 420 as $2\times r_{o4}=0.0036$ m.

Values of permeability $\mu$ for the four regions listed in FIG. 5 all correspond approximately to unity, $\mu_1=\mu_2=\mu_3=\mu_4=1$ respectively for air, Teflon and Teflon foam mixture. Values of permittivity $\in$ for these regions include $\in_1=1$ for air in the first section 120, $\in_2=2.1$ for Teflon in the outer envelope 160, and $\in_3=\in_4=1.65$ for the Teflon foam mixture in the inner envelopes 162 and 430. Values for impedance for these corresponding regions include $Z_{o1}=Z_{o3}=Z_{o4}=100\Omega$, and $Z_{o2}=0.244\Omega$.

Figure 6:
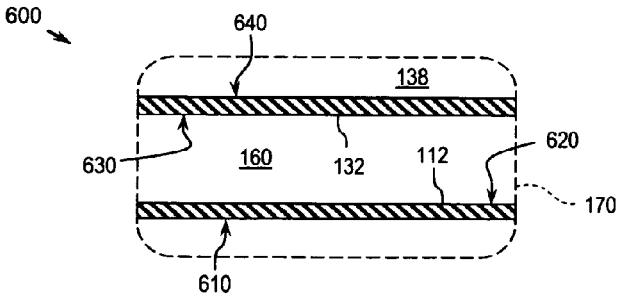
FIG. 6 is an elevation cross-sectional detail view of the cylindrical tubes.
Figure 7:
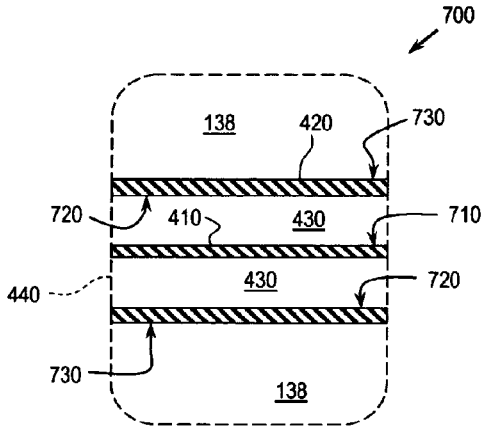
FIG. 7 is an elevation cross-sectional detail view of the wire and tube within an aft foam-filled region.

FIGS. 6 and 7 show respective cross-section views of detail regions 170 (FIG. 6) and 440 (FIG. 7). As shown in FIG. 6, the first such view 600 illustrates an external cylindrical periphery 610 and an internal cylindrical periphery 620 of the outer tube 112, an outer periphery 630 and inner periphery 640 of the inner tube 132. The internal and outer peripheries 620 and 630 can be coated with an electrically conductive layer and correspond to the respective diameters $2\times r_{o2}$ and $2\times r_{i2}$ from column 210 whose dimensions define an outer annular conduit of the outer annular envelope 160. The outer periphery 630 also defines the outer boundary of an inner annular region within the cavity 138. The outer envelope 160 and the cavity 138 are correspondingly filled with Teflon and mixed Teflon foam that have respective impedance values of 0.244Ω and 100Ω reported in column 230. As shown in FIG. 7, the second such view 700 illustrates an outer surface 710 of the wire 410, an inner surface 720 and an outer surface 730 of the hollow tube 420. The surfaces 710 and 720 define an inner boundary of the cavity 138. The surface 730 defines the inner annular region of the envelope 430 whose radial boundaries extend to diameter $2\times r_{i4}$ from column 510. These surfaces 710, 720 and 730 can be coated with an electrically conductive layer. The cavity 138 (extending radially from diameter $2\times r_{i3}$ to $2\times r_{o3}$) and the envelope 430 within the hollow tube 420 are filled with Teflon foam as identified in column 520 and impedances from column 530.

The folded coaxial RF mirror 100 is to be used in a field deployable RF Fabry-Perot interferometer used in a RF Brillouin Scattering radar. The mirror 100 reduces the overall size and increases the ruggedness of a more conventional RF mirror. Conventionally, a coaxial RF mirror may be constructed from co-linear concatenated sections of coaxial transmission line alternating between sections with high and low characteristic impedance. Because each section of the mirror is quarter-wavelength (¼λ) long at the center frequency of the mirror's operation, the conventional co-linear mirror can be quite lengthy at low frequencies.

For a mirror made from rigid materials, the need for a dielectric Bragg-mirror to have a high Q-resonation necessitates the construction of the mirror from a metal, such as copper, having very high conductivity. However, copper is a relatively soft metal and prone to bending or crushing, as well as being a difficult material to machine. Conceivably, a coaxial. RF mirror could also be constructed from flexible cable, but such a mirror would have degraded performance. This is because the performance of this mirror although improves as the impedance contrast increases, it can be difficult to obtain a great deal of contrast between the characteristic impedances utilizing commercially available coaxial cable.

Multiple coaxial cables, such as assemblies 110 and 130, are nested within each other to achieve the requisite alternating high and low characteristic impedances. The radii are varied and dielectrics can be carefully selected to achieve the desired characteristic impedance in each section. The mirror 100 demonstrates an exemplary embodiment with three folded sections. However, the design can be easily extendable to an arbitrary number of folded sections.

The input side has a section of 50Ω transmission line of arbitrary length terminated with a General Radio Type 874 (GR874) input connector 126 (or type-N) and the output side has a section of 50Ω semi-rigid coax of arbitrary length terminated with an SMA output connector 148. In the cross-section diagram of mirror 100 and the first table 210, the notations $r_{i1}$, $r_{i2}$, $r_{i3}$ signify the radii of the inner conductor (being outer peripheries of the respective fore rod 122, inner tube 132 and the aft rod 144), and $r_{o1}$, $r_{o2}$, $r_{o3}$ the radii of the outer conductor of the respective first, second and third sections of coaxial transmission line (being inner surfaces of the outer tube in the first and second sections and the inner surface of the inner tube). In the cross-section diagram of mirror 400 and the third table 510, the notations $r_{i4}$ and $r_{o4}$ ($=r_{i3}$) respectively signify the inner and outer radii of the hollow tube 420. This structure for the mirror 100 is thus physically shorter than the conventional design due to the nesting of the coaxial transmission lines. The mirror 100 can be constructed of silver or gold-plated brass to maintain the high Q and improve the ruggedness of the structure. The layers 610, 620, 630, 640, 710, 720 and 730 can be selectively coated with such electrically conductive metals.

Interferometer tests have been conducted with three-and-one-half-wavelength (3½λ) quarter-wave tube of copper with slugs to provide a mirror antenna for ultra-high-frequency (UHF) waves. The phenomenon absorption and release of energy by photons from electron shells via acoustic travel has been demonstrated in the past. This can also be accomplished with radio waves, but with greater power levels because signal resolution from scatter cross-section diminishes as the fourth power of frequency, as $\psi^4$, or of the wavelength inverse, as $\lambda^{-4}$. Electromagnetic signals are typically employ much shorter wavelengths than acoustic signals.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A coaxial mirror for reflecting an electromagnetic signal in a narrow band filter, said mirror comprising:

an outer pipe bounded by a first envelope between initial and final terminals that define a first cavity, wherein an input port attaches upstream to said initial terminal and an outlet port attaches downstream to said final terminal;

an inner pipe bounded by a second envelope between a closed fore end and an open aft end adjacent said final terminal, said inner pipe being coaxially disposed between said initial and final terminals within said first envelope to form an annular conduit;

a first rod, coaxially disposed within said first envelope, extending from said input port to said fore end;

a conductor, coaxially disposed within said second envelope, extending from said fore end to an axial location between said fore and aft ends; and a second rod, coaxially disposed within said inner pipe, extending from said axial location to said final terminal, wherein said input port receives the electromagnetic signal, said outer pipe passes the electromagnetic signal within said first envelope along said annular conduit to said open aft end of said inner pipe, said inner pipe reverses the electromagnetic signal from said open aft end to said closed fore end, said conductor passes the electromagnetic signal from said closed fore end, said second rod passes the electromagnetic signal from said conductor to said final terminal, and said outlet port transmits the electromagnetic signal.

2. The coaxial mirror according to claim 1, wherein said outer and inner pipes are respective cylindrical tubes, such that said first and second envelopes constitute respective first and second cylinders.

3. The coaxial mirror according to claim 1, wherein said annular conduit between said inner and outer pipes is filled with a fluoropolymer, and an annular cavity within said inner pipe is filled with a foam containing said fluoropolymer.

4. The coaxial mirror according to claim 1, wherein said outer pipe has an electrically conductive inner surface, said inner pipe has electrically conductive inner and outer surfaces, and said first and second rods have respective conductive surfaces.

5. A coaxial mirror for reflecting an electromagnetic signal in a narrow band filter, said mirror comprising:

an outer pipe bounded by a first envelope between initial and final terminals that define a first cavity, wherein an input port attaches upstream to said initial terminal and an outlet port attaches downstream to said final terminal;

an inner pipe bounded by a second envelope between a closed fore end and an open aft end adjacent said final terminal, said inner pipe being coaxially disposed between said initial and final terminals within said first envelope to form an annular conduit;

a solid rod, coaxially disposed within said first envelope, extending from said initial terminal to said fore end;

a communication wire, coaxially disposed within said first and second envelopes, extending from said fore end to said final terminal; and a hollow rod, coaxially disposed within said first and second envelopes and surrounding a portion of said communication wire, extending from an opening downstream of said fore end to said final terminal at said output port, wherein said input port receives the electromagnetic signal, said outer pipe passes the electromagnetic signal within said first envelope along said annular conduit to said open aft end of said inner pipe, said inner pipe reverses the electromagnetic signal from said open aft end to said closed fore end, said wire passes the electromagnetic signal from said closed fore end to said final terminal, and said outlet port transmits the electromagnetic signal.

6. The coaxial mirror according to claim 5, wherein said outer and inner pipes are respective cylindrical tubes, such that said first and second envelopes constitute respective first and second cylinders.

7. The coaxial mirror according to claim 5, wherein said annular conduit between said inner and outer pipes is filled with a fluoropolymer, a first annular cavity within said inner pipe is filled with a foam containing said fluoropolymer, and a second annular cavity within said hollow rod is filled with said foam.

8. The coaxial mirror according to claim 5, wherein said outer pipe has an electrically conductive inner surface, said inner pipe has electrically conductive inner and outer surfaces, and said solid and hollow rods have respective conductive surfaces.

* * * * *